United States Patent [19]

Kurushima et al.

[11] Patent Number: 4,483,135

[45] Date of Patent: Nov. 20, 1984

[54] DUST-REMOVING MECHANISM IN OPEN-END SPINNING FRAME

[75] Inventors: Tadanori Kurushima, Kariya; Kazuo Kamiya, Nishio, both of Japan

[73] Assignee: Seisakusho Kabushiki Kaisha Toyoda Jidoshokki, Kariya, Japan

[21] Appl. No.: 547,770

[22] Filed: Nov. 2, 1983

[30] Foreign Application Priority Data

Nov. 5, 1982 [JP] Japan ..... 57-193322

[51] Int. Cl.[3] ..... D01H 7/888; D01H 11/00

[52] U.S. Cl. ..... 57/301; 57/411

[58] Field of Search ..... 57/301, 302, 304, 305, 57/408, 411

[56] References Cited

U.S. PATENT DOCUMENTS

| | | | |
|---|---|---|---|
| 3,797,218 | 3/1974 | Landwehrkamp et al. | 57/301 X |
| 3,839,855 | 10/1974 | Stalder | 57/408 |
| 4,142,356 | 3/1979 | Husges et al. | 57/301 |
| 4,204,393 | 5/1980 | Miyazaki et al. | 57/301 |
| 4,249,370 | 2/1981 | Vecera et al. | 57/411 X |
| 4,314,440 | 2/1982 | Onoue et al. | 57/301 |

*Primary Examiner*—John Petrakes

*Attorney, Agent, or Firm*—Brooks, Haidt, Haffner & Delahunty

[57] ABSTRACT

A dust-removing mechanism in an open-end spinning frame has a dust-removing chamber into which a dust-removing opening opens, the dust-removing opening being defined by a rear wall disposed upstream in the direction of rotation of the combing roller and having an edge and a front wall disposed downstream in the direction, there being an angle $\alpha$ formed between first and second lines passing through the front and rear wall edges and the center of the combing roller, an angle $\beta$ formed between a third line passing through the center of the combing roller and the center of an opening in the rotor and a fourth line passing through the center of the combing roller perpendicularly to the third line, an angle Y formed between a surface of the front wall and a fifth line extending parallel to the fourth line through the front wall edge, and an angle $\delta$ formed between a surface of the rear wall and a sixth line extending parallel to the fourth line through the rear wall edge, the angles being in the following ranges:

$40° \leqq \alpha \leqq 45°$ $0° \leqq \beta \leqq 5°$ $40° \leqq Y \leqq 45°$ $0° \leqq \delta \leqq 20°$.

5 Claims, 4 Drawing Figures

DUST-REMOVING MECHANISM IN OPEN-END SPINNING FRAME

BACKGROUND OF THE INVENTION

1. Field of the Invention

The present invention relates to a dust-removing mechanism in an open-end spinning frame.

2. Description of the Prior Art

FIG. 1 of the accompanying drawings illustrates a conventional open-end spinning frame. A sliver A as it is introduced into a spinning unit 1 is advanced while being sandwiched between a feed roller 2 and a presser 3, and is separated into fibers by a combing roller 4 which rotates at a high speed that is surrounded by an outer wall 20 extending along the outer peripheral surface of the combing roller 4 with a predetermined clearance therebetween. The separated fibers are then transferred in the direction of the arrow along the circumferential surface of the combing roller 4 into a fiber feed channel 5. The fibers as they emerge from the fiber feed channel 5 are carried on a current of air and rotated at a high speed, and then are deposited on an inner peripheral surface of a rotor 6 in which a vacuum is developed. The fibers are thereafter pulled as a yarn out of a yarn delivery passage (not shown), and the yarn is wounded on a bobbin to form a yarn package.

The outer wall 20 has an opening 21 through which the circumferential surface of the combing roller 4 is partially exposed to a dust-removing chamber 7 disposed adjacent to the combing roller 4. Impurities and foreign matter B such as leaf pieces and neps, for example, in the sliver are discharged through the opening 21 into the dust-removing chamber 5 under centrifugal forces of the combing roller 4 as it separates the sliver. Other impurities and foreign matter B such for example as short fibers, waste cotton, and dust are separated from the surface of the combing roller 4 by an air stream produced by the rotation of the latter and then are discharged into the dust-removing chamber 7. The dust-removing chamber 7 has a small air inlet **7*a* in one end thereof, but is of a substantially closed construction. The other end of the dust-removing chamber 7 has an outlet 7*b* connected to a trash pipe 8 for delivering the impurities B. The trash pipe 8 is coupled to a side of a dust collector duct 9 which is shared by other spinning units. The dust collector duct 9 leads through an air blower 10 to a dust collector chamber (not shown). The impurities B separated and discharged into the dust-removing chamber 7 are discharged therefrom into the trash pipe 8 on a suction stream of air created by the action of the air blower 10, and then are collected through the dust collector duct 9** into the dust collector chamber.

The conventional dust-removing mechanism of the foregoing construction has suffered from the following shortcoming: As described above, the impurities B are carried on a current of air from the dust-removing chamber 7 into the trash pipe 8. Since it is necessary to develop a relatively strong suction air stream in the dust-removing chamber 7 for delivery of the impurities B, the dust-removing chamber 7 is of substantially closed construction. Therefore, a suction force due to the vacuum in the rotor 6 tends to be developed in the dust-removing chamber 7. This suction force is liable to cause the impurities B once separated from the fibers to be drawn back into the rotor 6 on a suction air stream generated by the latter, and to be deposited in the rotor 6. One solution to avoid such an undesirable phenomenon would be to increase the speed of air flow in the dust-removing chamber 7. However, such an air flow would peel not only the impurities but longer fibers off the surface of the combing roller 4, resulting in a poorer yarn yield. The outlet **7*b* of the dust-removing chamber 7** is constricted for increasing the speed of air flow and hence tends to get clogged with the impurities B passing therethrough.

SUMMARY OF THE INVENTION

It is an object of the present invention to provide a dust-removing mechanism for open-end spinning frames which has a dust-removing chamber vented to atmosphere for effective separation of impurities from a combing roller substantially without depending on a suction current of air, and which delivers out the separated impurities on an air stream or other means such as a conveyor.

Another object of the present invention is to provide a dust-removing mechanism having a large dust-removing opening and capable of separating impurities only, without discharging yarn-forming fibers.

According to the present invention, there is provided a dust-removing mechanism in an open-end spinning frame having a rotor, including a combing roller for separating a supplied sliver into fibers, an outer wall surrounding the combing roller and having a dust-removing opening, and a dust-removing chamber into which the dust-removing opening opens, so that impurities will be separated from the sliver by the combing roller and discharged through the dust-removing opening into the dust-removing chamber, wherein the improvement comprises a rear wall disposed upstream in the direction of rotation of the combing roller and having an edge and a front wall disposed downstream with respect to the direction of combing roller rotation, the front and rear wall edges jointly defining the dust-removing opening, there being an angle $\alpha$ formed between first and second lines passing through the front and rear wall edges and the center of the combing roller, an angle $\beta$ formed between a third line passing through the center of the combing roller and the center of an opening in the rotor and a fourth line passing through the center of the combing roller perpendicularly to the third line, an angle Y formed between a surface of the front wall and a fifth line extending parallel to the fourth line through the front wall edge, and an angle $\delta$ formed between a surface of the rear wall and a sixth line extending parallel to the fourth line through the rear wall edge, the angles being in the following ranges:

$$40° \leqq \alpha \leqq 45°$$

$$0° \leqq \beta \leqq 5°$$

$$40° \leqq Y \leqq 45°$$

$$0° \leqq \delta \leqq 20°$$

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 2:
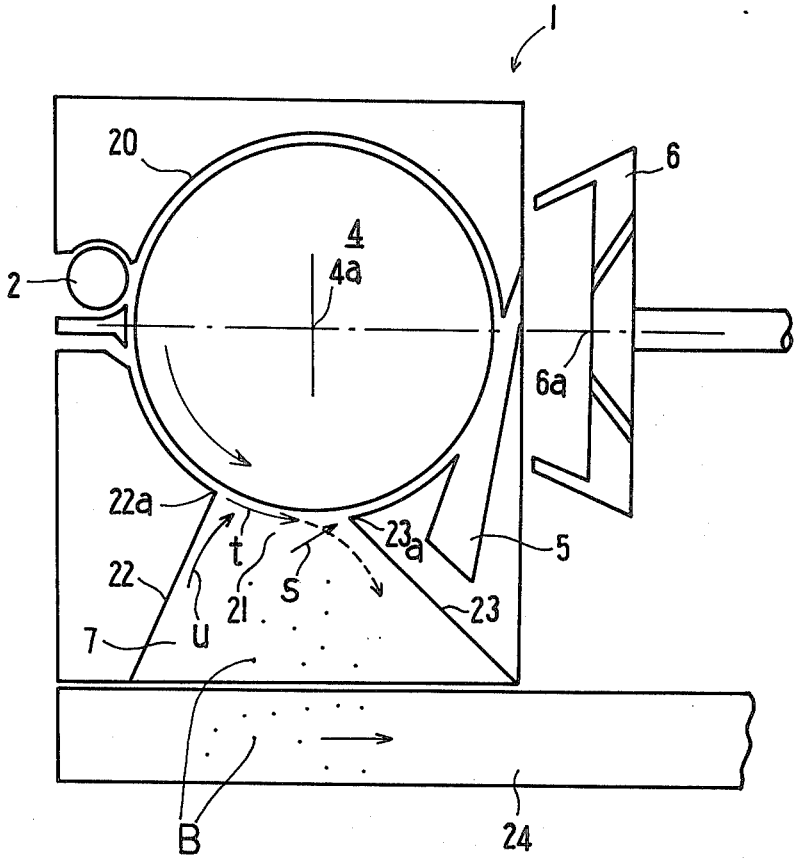
FIG. 2 is a plan view of a dust-removing mechanism showing the manner in which air flows in a dust-removing chamber.

As shown in FIG. 2, a spinning unit 1 to which the principles of the present invention are applicable includes combing roller 4 having a central axis 4*a* and a rotor 6 having a central axis 6*a* intersecting the central axis 4*a* at the center of the combing roller 4.

Figure 1:
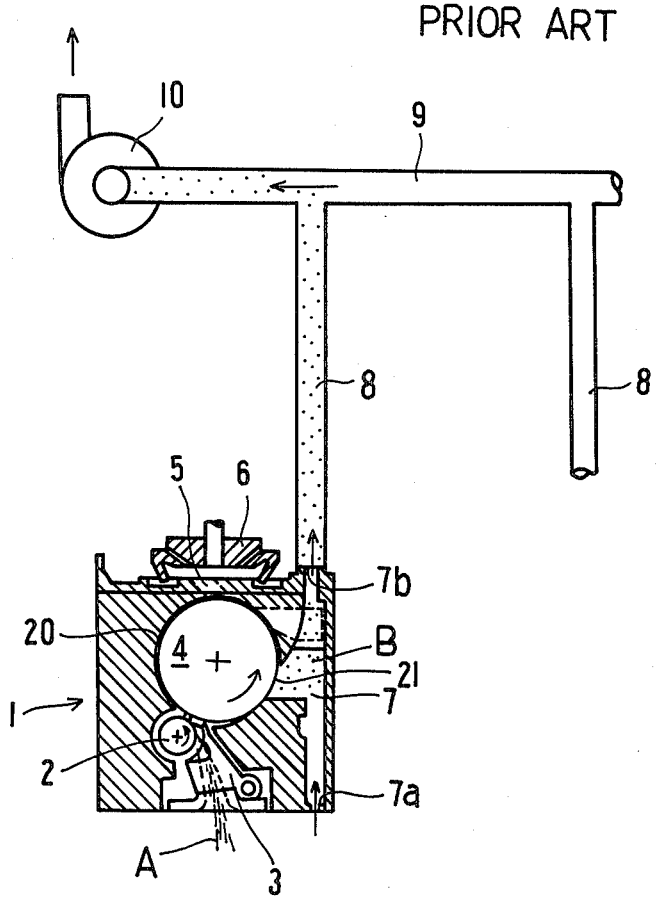
FIG.1 PRIOR ART
FIG. 1 is a cross-sectional view of a conventional dust-removing mechanism in an open-end spinning frame.

The combing roller 4 is surrounded by an outer wall 20 having a dust-removing opening 21 defined by a rear wall 22 disposed upstream in the direction (indicated by the arrow) of rotation of the combing roller 4 and a front wall 23 disposed downstream in the same direction. The dust-removing opening 21 communicates with an open-type dust-removing chamber 7 which is vented to atmosphere through an apertured plate or screen 11 (FIG. 4) covering the dust-removing chamber 7. Impurities B separated and discharged into the dust-removing chamber 7 fall onto a conveyor 24 positioned in the dust-removing chamber 7, and are delivered thereby in the direction of the arrow into a dust collector duct (shown at 9 in FIG. 1), from which they are carried on an air current into a dust collector chamber. Any suction current of air produced by an air blower (shown at 10 in FIG. 1) does not affect the dust-removing opening 21, and the air flow in the dust-removing chamber 7 remains substantially undisturbed by the suction air stream caused by the rotor 6.

With a conventional closed-type dust-removing chamber disclosed in Japanese Laid-Open Patent Publication No. 51-1732, the dust-removing capability is controlled by an angle Y′ formed between the front wall 23 and a line passing through an edge of the front wall 23 and the center 4*a* of the combing roller 4. For open-type dust-removing chambers, however, it has been found that the dust-removing capability is also affected by an opening angle $\alpha$, and the positions and inclinations of the front and rear walls.

More specifically, a consideration of dust-removing mechanisms in open-end spinning frames requires study of the behavior of currents of air in the area of the dust-removing opening. The study by the inventors has revealed that there are basically three currents of air involved in the dust-removing opening. One of the three currents of air is a suction current of air S produced by the rotation of the rotor 6 and directed toward the rotor 6 in the vicinity of the edge 23*a* of the front wall 23. The second air current is a stream of air t accompanying the rotating air flow along the outer peripheral surface of the combing roller 4. The third air current is a supplementing air flow u generated when the rotating air flow around the combing roller 4 is peeled off as a boundary layer, the supplementing air flow u being largely dependent on the shape of the dust-removing opening 21.

The components of the fibers separated by the combing roller 4 are divided into several groups according to form and gravity, and move on the rotating air flow between the combing roller 4 and the outer wall 20. When the fibers reach the dust-removing opening 21, relatively heavy seed pieces and neps fly out into the dust-removing chamber 7 under central forces. Those fibers which have large surface areas and a small apparent specific gravity remain trapped in the rotating air flow and move therewith. Other impurities B such as trash and dust, for example, having an intermediate specific gravity are displaced slightly radially outwardly into the accompanying air current t. For increased dust-removing capability, it is required that the accompanying air current t be spread in the dust-removing chamber 7 to discharge the impurities B such as trash and dust. If the dust-removing opening 21 were too small, the suction air current S would be too intensive to allow the accompanying air current t to be spread out since the latter would be repelled by the suction air current S and absorbed into the rotating air flow again.

Figure 3:
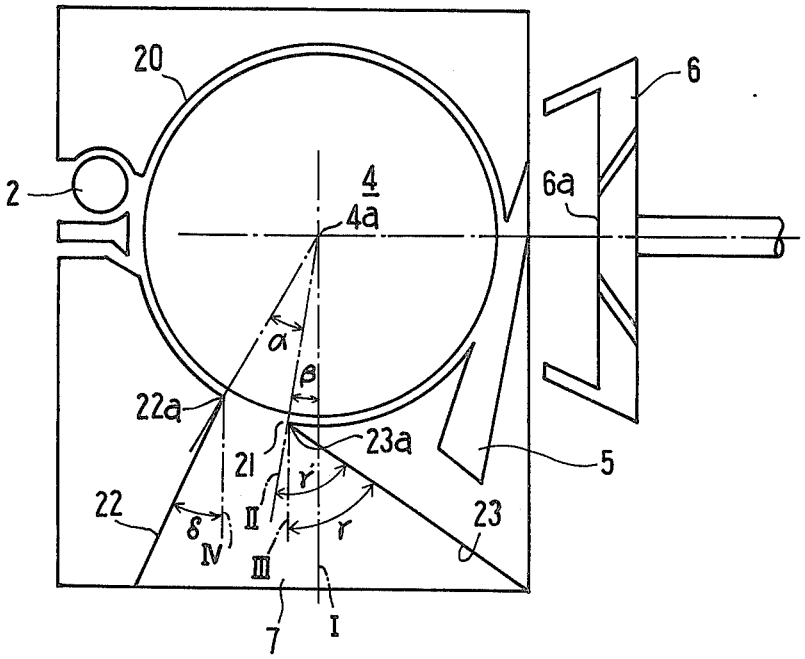
FIG. 3 is a plan view of a dust-removing chamber in a dust-removing mechanism according to the present invention.

As the dust-removing opening 21 is larger, the accompanying air flow t would be spread well for improved dust-removing capability. If the dust-removing opening 21 were too large, however, the rotating air flow would be peeled off as the boundary layer at an increased rate, with the result that the fibers would be disoriented and the supplementing air flow u would become stronger. The impurities once discharged would then be carried by the supplementing air flow u, join the rotating air flow and the suction air flow S, and be deposited in the rotor 6. Accordingly, there is a preferred range for the size of the dust-removing opening 21. In the following description, the size of the dust-removing opening 21 is defined by an opening angle $\alpha$, as shown in FIG. 3, which is formed between a line passing through the center 4*a* of the combing roller 4 and the edge 23*a* of the front wall 23 and a line passing through the center 4*a* and an edge 22*a* of the rear wall 22.

If the front wall edge 23*a* were displaced downstream for enlarging the dust-removing opening 21, the suction force caused by the rotor 6 would become more influential and the suction air current S would be increased. The impurities displaced into the accompanying air current t and tending to be separated from the rotating air flow would be blocked by the suction air current S and become more likely to join the rotating air flow. Therefore, there is a limitation on the position of the front wall edge 23*a* in the upstream direction. In the following description, the position of the front wall edge 23*a* is defined by an angle $\beta$, as shown in FIG. 3, formed between a line I passing through the center 4*a* of the combing roller 4 perpendicularly to a line connecting between the centers 6*a*, 4*a* of an opening in the rotor 6 and the combing roller 4, and a line II passing through the center 4*a* of the combing roller 4 and the front wall edge 23*a*.

If the angle of inclination of the front wall 23 were too large, then the rotating air flow caused by the rotation of the combing roller 4 would be peeled off by the edge 23*a*, disturbing the fibers and resulting in a loss of fibers. If the front wall 23 is inclined at a proper angle, then it allows the rotating air flow to move smoothly, and the accompanying air current t becomes a laminar flow along the front wall 23 for good dust removal. If the angle of inclination were too small, the rotating air flow and the accompanying air current t would impinge on the front wall 23, producing swirls which would be carried on the suction air current S to permit the separated impurities to be absorbed again into the rotor 6. Accordingly, it is expected that there is a preferred range of angles of inclination of the front wall 23.

The angle of inclination of the front wall 23 is defined by an angle Y formed between a line III parallel to the line I and the surface of the front wall 23.

The position of the edge 22*a* of the rear wall 22 is directly related to the size of the dust-removing opening 21, and the edge 22*a* has the same function as that of the front wall edge 23*a*.

If the angle of inclination of the rear wall 22 were too large, the accompanying air current t produced by the rotation of the combing roller 4 would easily be dispersed for increased dust removal efficiency, but the supplementing air current u for compensating for a boundary layer separation would be increased and the impurities to be absorbed again into the rotor 6 would be increased, resulting in a poorer yarn quality. If the angle of inclination of the rear wall 22 were too small, it would become difficult for the accompanying air current t to be dispersed, lowering the dust removal efficiency. Therefore, there is a proper rear wall position and a proper angle of inclination of the rear wall 22. In the following description, the angle of inclination of the rear wall 22 is defined by an angle δ formed between a line IV parallel to the line I and the surface of the rear wall 22.

According to the present invention, it is required that the edge 23*a* of the front wall 23 be positioned on the line I or upstream of the line I, and the angle β be in the range of from 0° to 5°. It is preferred that the angle α of the dust-removing opening 21 be in the range of from 40° to 45°.

It is also preferred that the angle Y of inclination of the front wall 23 be in the range of from 40° to 45° and the angle δ of inclination of the rear wall 22 be in the range of from 0° to 20°.

The advantages of the present invention will appear clear from the following example:

EXAMPLE

Using the spinning unit as shown in FIG. 2 with dimensions varied, spinning operations were effected under the following spinning conditions:

Sliver supplied:
Material: Cotton 100%
Fineness: 4.3 g/in.
Average fiber length: 23 mm
Grain: 420 gr/6 yd
Sliver U%: 4.0%
Trash content: 250 mg/kg
Spinning condition:
Spinning time: 8 H
Yarn count: 7' S
Twist constant: 4.8
Rotor RPM: 60,000 rpm
Combing roller RPM: 8,000 rpm The quality of yarns produced is evaluated according to U%, and the dust removal efficiency is evaluated according to the amount of dust deposited in the rotor. The results are shown in the following table:

TABLE

| Items | | No. 1 | 2 | 3 | 4 | 5 | 6 | 7 | 8 | 9 | 10 | 11 | 12 | Remarks |
|---|---|---|---|---|---|---|---|---|---|---|---|---|---|---|
| Inventive device (marked with O) | | x | O | O | O | x | O | O | O | x | x | x | x | No. 12 = closed dust-removing chamber (suction pressure = 110 mmAg) |
| Dust-removing chamber dimensions | $\alpha^o$ | 35 | 40 | 45 | 45 | 45 | 45 | 40 | 45 | 55 | 55 | 45 | 35 | |
| | $\beta^o$ | 5 | 5 | 5 | 0 | 5 | 5 | 5 | 0 | 5 | 10 | −5 | 5 | |
| | $\gamma^o$ | 40 | 40 | 45 | 40 | 45 | 45 | 45 | 45 | 45 | 40 | 40 | 40 | |
| | $\delta^o$ | 0 | 5 | 10 | 0 | −20 | 0 | 20 | 20 | 0 | 0 | 0 | 0 | |
| Amount of deposit in rotor mg/kg | | 1.5 | 0.4 | 0.3 | 0.7 | 1.4 | 0.6 | 1.5 | 0.3 | 2.5 | 0.9 | 1.7 | 1.3 | |
| U % | Start | 9.8 | 9.8 | 9.8 | 9.8 | 10.1 | 9.8 | 9.8 | 9.7 | 13.2 | 10.7 | 10.1 | 9.8 | |
| | End | 10.0 | 9.8 | 9.8 | 9.8 | 10.4 | 9.8 | 9.8 | 9.7 | 13.9 | 10.9 | 10.6 | 9.9 | |

As is apparent from the above table, the amounts of deposited dust in the rotor after 8 hours of operation of the spinning unit equipped with the dust-removing chamber according to the present invention are all below 1.0 mg/kg, and therefore the dust-removing chamber of the invention has an excellent dust removal efficiency. The U% of the spun yarns is 10% or below, and hence the dust-removing mechanism of the invention achieves a good yield of fibers of good quality.

With the arrangement of the present invention, the dust-removing chamber is of the open type vented to atmosphere, and hence is free from a reduced dust removal efficiency and a poor yarn yield due to mutual interaction of air currents in the dust-removing chamber. The dimensions and angles of the dust-removing chamber are selected to be optimum so that yarns can be spun under good conditions for stable yarn spinning operation.

Figure 4:
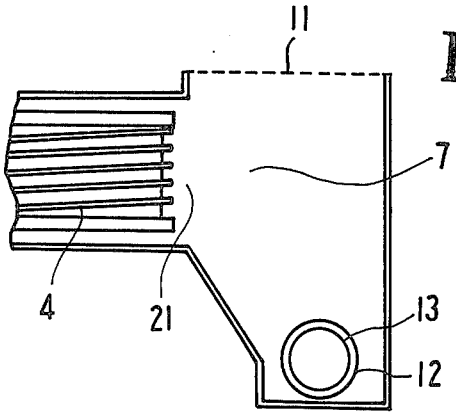
FIG. 4 is a side elevational view of a dust-removing chamber according to another embodiment of the present invention.

While in the embodiment of FIG. 2 the conveyor 24 is employed for discharging the impurities B, an opening 12 and a confronting suction inlet 13 may be provided in a lower portion of the dust-removing chamber, as shown in FIG. 4, for delivering dust on an air stream. Since the dust-removing chamber is open to atmosphere, the air stream flowing through the opening 12 and the suction inlet 13 is under a low pressure, and therefore does not adversely affect the dust removal operation.

In the illustrated embodiment, the combing roller 4 has a vertical central axis. However, the combing roller 4 may be arranged such that its central axis extends horizontally. The rotor 6 according to the foregoing embodiment is of the self-discharge type having an air-discharging hole. However, the present invention is also applicable to a rotor of the forced-discharge type having no air-discharging hole.

Although certain preferred embodiments have been shown and described, it should be understood that many changes and modifications may be made therein without departing from the scope of the appended claims.

What is claimed is:

1. A dust-removing mechanism in an open-end spinning frame having a rotor, including a combing roller for separating a supplied sliver into fibers, an outer wall surrounding said combing roller and having a dust-removing opening, and a dust-removing chamber into which said dust-removing opening opens, so that impurities will be separated from the sliver by said combing roller and discharged through said dust-removing opening into said dust-removing chamber, wherein the improvement comprises a rear wall disposed upstream in the direction of rotation of said combing roller and having an edge and a front wall disposed downstream in said direction, said front and rear wall edges jointly defining said dust-removing opening, there being an angle $\alpha$ formed between first and second lines passing through said front and rear wall edges and the center of said combing roller, an angle $\beta$ formed between a third line passing through the center of said combing roller and the center of an opening in the rotor and a fourth line passing through the center of said combing roller perpendicularly to said third line, an angle Y formed between a surface of said front wall and a fifth line extending parallel to said fourth line through said front wall edge, and an angle $\delta$ formed between a surface of said rear wall and a sixth line extending parallel to said fourth line through said rear wall edge, said angles being in the following ranges:

$$40° \leqq \alpha \leqq 45°$$

$$0° \leqq \beta \leqq 5°$$

$$40° \leqq Y \leqq 45°$$

$$0° \leqq \delta \leqq 20°$$

2. A dust-removing mechanism according to claim 1, wherein said front wall edge is located more closely than said fourth line to said rear wall.

3. A dust-removing mechanism according to claim 1, wherein said dust-removing chamber is of the open-type substantially vented to atmosphere.

4. A dust-removing mechanism according to claim 3, wherein said dust-removing chamber is covered at its upper portion by an apertured plate through which the dust-removing chamber is vented to atmosphere.

5. A dust-removing mechanism according to claim 3, wherein said dust-removing chamber is covered at its upper portion by a screen through which the dust-removing chamber is vented to atmosphere.

* * * * *